US005522749A

United States Patent [19]

McNaughton

[11] Patent Number: 5,522,749

[45] Date of Patent: Jun. 4, 1996

[54] POSITIVE OXYGEN MASK RELEASE

[75] Inventor: John F. McNaughton, Fullerton, Calif.

[73] Assignee: H. Koch & Sons Co., Anaheim, Calif.

[21] Appl. No.: 364,373

[22] Filed: Dec. 27, 1994

[51] Int. Cl.[6] ..... B63C 9/00

[52] U.S. Cl. ..... 441/88; 441/116; 441/118; 2/6.1

[58] Field of Search ..... 441/83, 88, 105, 441/116, 117, 118, 136

[56] References Cited

U.S. PATENT DOCUMENTS 2,950,488 8/1960 Sabo ..... 441/116

3,497,889 3/1970 Mellin, Jr. et al. ..... 441/118

4,869,245 9/1989 Nowakowski et al. ..... 2/422

*Primary Examiner*—Jesus D. Sotelo

*Attorney, Agent, or Firm*—David A. Greenlee

[57] ABSTRACT

An aviator has a protective helmet and an oxygen mask releasably attached to the helmet by a mask release which automatically releases one of the mask connections to the helmet upon water immersion. An inflatable life preserver worn by the aviator has two spaced projections mounted on its upper outer surface directly beneath the mask. These projections contact the lower portion of the mask during life preserver inflation and gradually forcibly push the released mask away from the aviator's face as the life preserver further inflates.

6 Claims, 2 Drawing Sheets

FIG 1
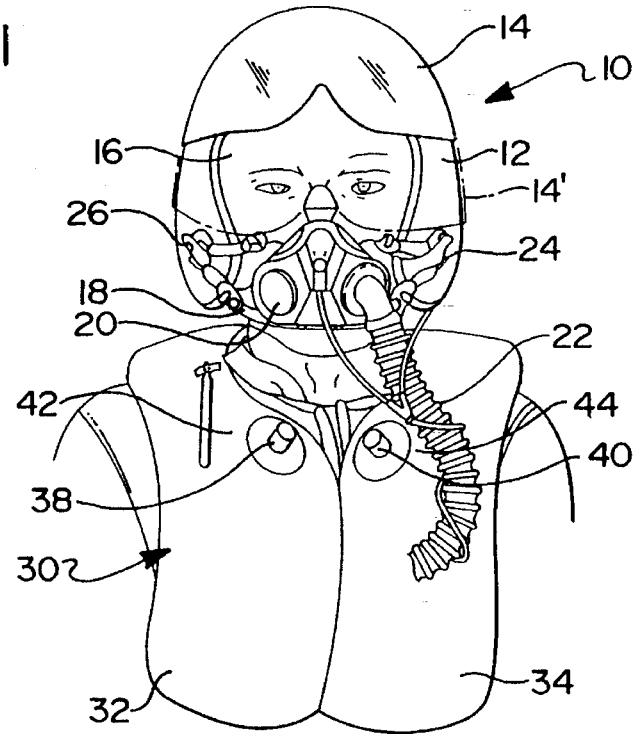
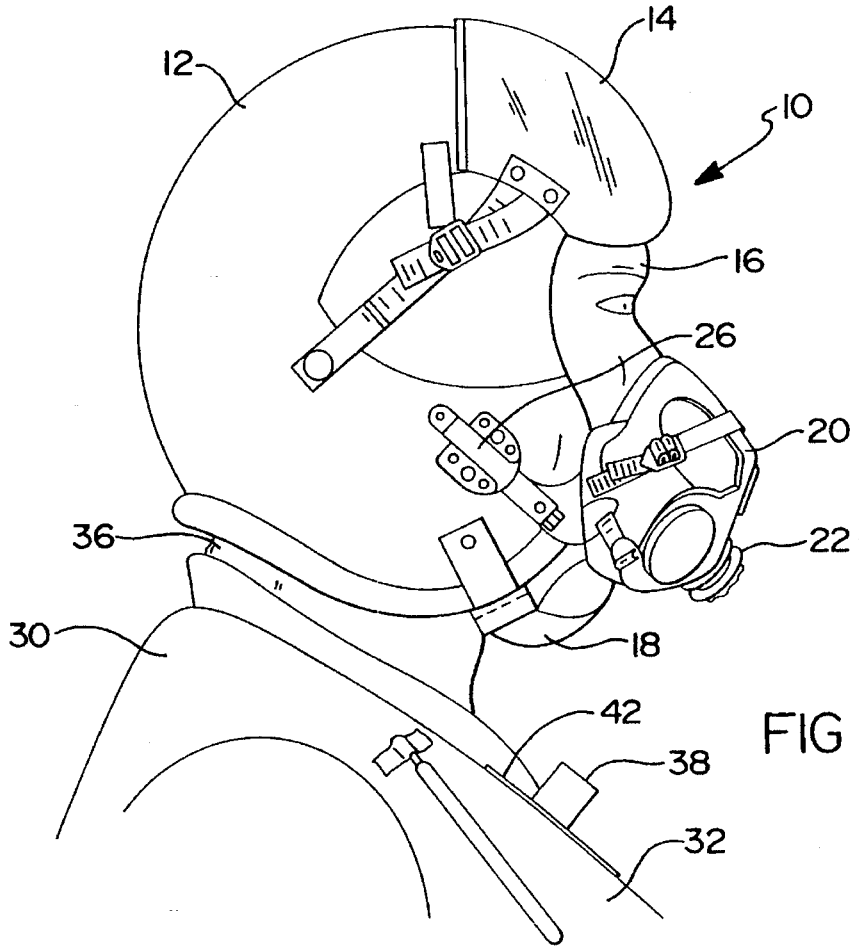
FIG 2

POSITIVE OXYGEN MASK RELEASE

BACKGROUND OF THE INVENTION

This invention relates generally to oxygen mask releases and, more particularly, to a device for positively removing a released oxygen mask from the face of a wearer.

Pilots and other aircraft crewmen, or aviators, wear oxygen masks which are secured to their protective helmets by a releasable device. When a crewman ejects from an aircraft in an emergency, the mask's oxygen hose automatically separates from the aircraft oxygen supply and the free end dangles below his shoulders.

As the crewman descends, the dangling supply hose enables breathing of atmospheric air through it. If the crewman has ejected over a body of water, contact with water will cause the dangling supply hose to submerge. If the crewman is disabled, unconscious, or otherwise unable to remove the mask, he may suffocate or drown.

To prevent such an occurrence, an automatic disconnect device (called a WAMRS—Water Activated Mask Release System) has been developed to automatically release the mask from the helmet. Such a device is disclosed in U.S. Pat. No. 4,869,245 to Nowakowski et al. In this device, water immersion causes an explosive squib to separate one of the mask attachments to the helmet, thus freeing the mask for removal. Unfortunately, this released mask sometimes remains affixed to the crewman's face for a variety of reasons.

It would be desirable to prevent mask retention and to assure mask removal from the wearer's face by providing a device for positively forcing the released mask away from the aviator's face.

SUMMARY OF THE INVENTION

It is therefore an object of this invention to prevent mask retention and to assure mask removal from the wearer's face by providing a device for positively forcing the released mask away from the aviator's face.

In one aspect, this invention features a positive mask release for positively removing an oxygen mask from the face of an aviator who is wearing an inflatable life preserver and a protective helmet to whose face the mask is releasably attached. The release comprises an abutment surface carried by the life preserver for engagement with the mask which, upon release of the mask and inflation of the life preserver, pushes the mask away from the aviator's face.

In another aspect, this invention features a positive mask release for positively removing an oxygen mask from the face of an aviator wearing an inflatable life preserver and a protective helmet to whose face the mask is releasably attached by an automatic mask release device. The release preferably comprises a pair of spaced projections which extend from the upper outer surface of the inflating life preserver into engagement with the lower portion of the mask to push the mask upward and away from the aviator's face as the life preserver further inflates.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 1 is a partial frontal view of an aviator wearing a protective helmet with attached oxygen mask and a life preserver incorporating a positive mask release, according to this invention;

FIG. 2 is an enlarged side view of the aviator of FIG. 1;

DETAILED DESCRIPTION OF A PREFERRED EMBODIMENT

Figure 3:
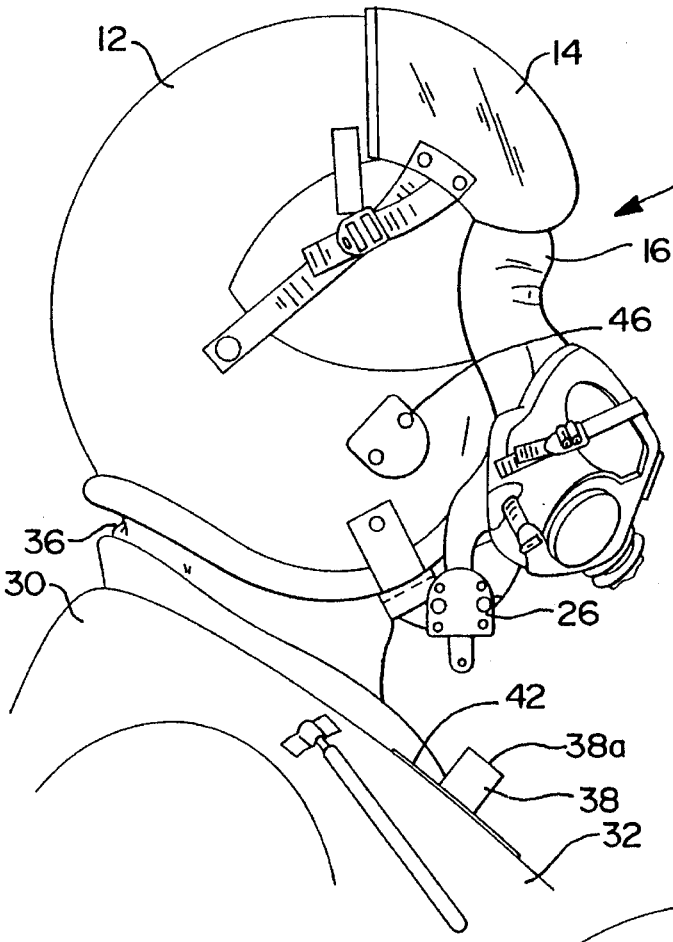
FIG. 3 is a view similar to FIG. 2, but with the mask released.
Figure 4:
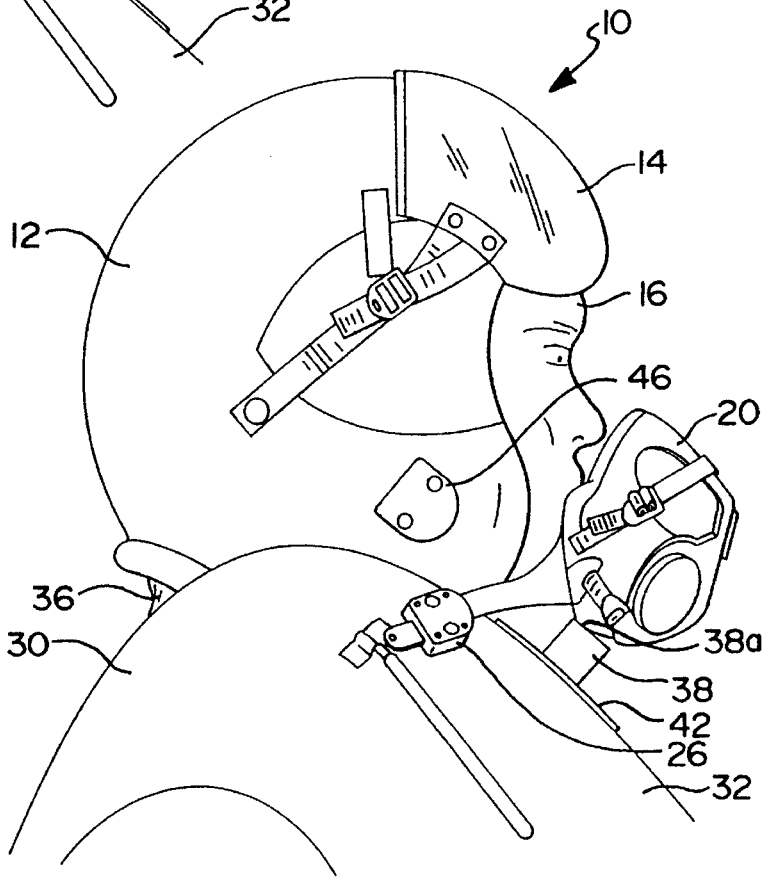
FIG. 4 is a view similar to FIG. 3, but with the life preserver inflated and the mask positively removed from the aviator's face.

As shown in FIGS. 1 and 2 of the drawings, an aviator 10, such as a pilot or aircrewman, wears a protective helmet 12 that has a visor movable between a raised position 14 (solid lines) and a lowered position 14" (phantom lines) to cover his face 16. A chin strap 18 secures the helmet 12 in place.

To aid in breathing, the aviator 10 is provided with the usual oxygen mask 20 which has a supply hose 22 for supplying breathing gas to the mask from an aircraft supply when connected (not shown). Mask 20 is releasably attached to helmet 20 at its sides by connectors 24 and 26. Connector 26 incorporates a WAMRS, discussed above, which automatically releases one side of mask 20 upon water immersion. This frees aviator 10 from breathing through supply hose 22 and enables him to breath atmospheric air directly.

Aviator 10 wears a generally conventional inflatable life preserver 30 that includes two inflatable chest cells 32 and 34 which are connected about the aviator's neck 36, which automatically inflates upon water immersion. However, unconventionally, life preserver 30 mounts spaced two rubber projections 38 and 40 which are mounted on the upper portions 42 and 44 of inflatable cells 32 and 34 which are located directly beneath mask 20, as illustrated in FIG. 2.

Upon emergency ejection from an aircraft (not shown), aviator 10 will appear as in FIGS. 1 and 2, with mask 12 attached and life preserver 30 uninflated. Breathing is accomplished through the dangling supply tube 22. If a water landing is experienced, inertia will temporarily submerge aviator 10, including his helmet 12, supply tube 22, and mask connection 26. The WAMRS will automatically activate to disengage connector 26 from its helmet mounting 46, as shown in FIG. 3.

Life preserver 30, being also water-activated, will automatically begin to inflate cells 42 (and, similarly, 44, not illustrated). This will push projections 38 (and 40) upward so that their contact surfaces (only **38*a* shown) contact the bottom of mask 20. Upon further inflation, projections 38 and 40 will forcibly push mask 20 off the aviator's face 16, enabling direct breathing of atmospheric air through his nose and mouth, which are held above water level by inflated life preserver 30**.

Thus, mask 20 is positively removed from the aviator's face, which enables him to breath directly, whether he is conscious or unconscious. This positive mask release is enabled by the automatic release of mask 20 from helmet 12 by the WAMRS, followed by the forcible movement of mask 20 away from the face 16 by the projections 38 and 40.

The exact number, shape, size, location and composition of projections could be other than as disclosed. It is necessary only that they provide an abutment surface which will engage and positively move the mask away from the face upon life preserver inflation.

While only a preferred embodiment has been illustrated and described, obvious modifications thereof are contemplated within the scope of this invention and the following claims.

I claim:

1. A positive mask release for positively removing an oxygen mask from the face of an aviator wearing an inflatable life preserver and a protective helmet to which the mask is releasably attached, comprising an abutment surface carried by the life preserver for engagement with the mask, upon release of the mask and inflation of the life preserver, to push the mask away from the aviator's face.

2. A positive mask release for positively removing an oxygen mask from the face of an aviator wearing an inflatable life preserver and a protective helmet to which the mask is releasably attached by an automatic mask release device, comprising abutment means carried by the life preserver for engagement with the mask, upon release of the mask by the release device and inflation of the life preserver, to push the mask away from the aviator's face.

3. The positive mask release of claim 2, wherein the abutment means comprise a projection extending from the upper outer surface of the inflating life preserver into engagement with the mask.

4. The positive mask release of claim 3, wherein the abutment means comprise a pair of spaced projections which extend from the outer surface of the inflating life preserver into engagement with the lower portion of the mask to push the mask upward and away from the aviator's face as the life preserver further inflates.

5. The positive mask release of claim 4, wherein the projections are rubber plugs mounted on the upper portions of the upper surface of the life preserver directly beneath the mask.

6. A positive mask release for positively removing an oxygen mask from the face of an aviator wearing an inflatable life preserver and a protective helmet, to which the mask is releasably attached by a water-activated automatic mask release device, during a water landing, comprising a pair of spaced projections which extend from the upper outer surface of the inflating life preserver into engagement with the lower portion of the released mask to push the mask upward and away from the aviator's face as the life preserver further inflates.

* * * * *